US006254404B1

(12) United States Patent
Sedlecky

(10) Patent No.: US 6,254,404 B1
(45) Date of Patent: Jul. 3, 2001

(54) GROUND APPARATUS FOR SHIELDED CABLE AND METHOD OF USING SAME

(75) Inventor: Daniel P. Sedlecky, Naperville, IL (US)

(73) Assignee: Marconi Communications, Inc., Cleveland, OH (US)

( * ) Notice: Subject to any disclaimer, the term of this patent is extended or adjusted under 35 U.S.C. 154(b) by 0 days.

(21) Appl. No.: 09/537,021

(22) Filed: Mar. 28, 2000

(51) Int. Cl.[7] ..... H01R 13/648
(52) U.S. Cl. ..... 439/98
(58) Field of Search ..... 439/94, 96, 98, 439/99, 100, 97, 101, 102

(56) References Cited

U.S. PATENT DOCUMENTS 3,194,877 * 7/1965 Collier ..... 174/88
3,617,611 * 11/1971 Kuether ..... 174/51
3,728,473 * 4/1973 Kuo ..... 174/84 C
3,753,213 * 8/1973 Frey ..... 439/410
4,291,934 * 9/1981 Kund ..... 439/421
4,334,726 * 6/1982 Kund ..... 439/99
4,973,259 11/1990 Sachs .
5,429,532 7/1995 Auclair .
5,432,301 7/1995 Gehring .
5,554,825 9/1996 Parker et al. .
5,597,314 1/1997 Auclair et al. .
5,769,661 6/1998 Nealis .

* cited by examiner

*Primary Examiner*—Neil Abrams
*Assistant Examiner*—J. F. Duverne
(74) *Attorney, Agent, or Firm*—Jones, Day, Reavis & Pogue

(57) ABSTRACT

A ground tie apparatus for electrically connecting a shield from a shielded cable to a ground terminal. The ground tie is formed of an integrally connected copper strip having two end portions, two tabs connected to one of the end portions and a sleeve connected to the other of the end portions. Closely located to the first end portion is a plurality of sharp teeth. The tie is connected to the shield by wrapping the portion of the strip with the teeth around the circumference of the shield and crimping the tabs about the strip.

11 Claims, 3 Drawing Sheets

GROUND APPARATUS FOR SHIELDED CABLE AND METHOD OF USING SAME

BACKGROUND OF THE INVENTION

1. Field of the Invention

The present invention relates to a ground tie and more particularly to an inexpensive flexible electrically conductive strip for connecting a shield of a shielded cable to a ground terminal.

2. Description of the Related Art

There is often a need to ground the shield of a shielded electrical cable. Typically this is done by removing an outer insulative cover to expose the shield, then cutting or splitting the tubular shield in a longitudinal direction and attaching an electrically conductive clip to one of the cut portions or flaps of the shield. The shield typically is very thin and relatively delicate aluminum so that the already cut shield is prone to tear during handling.

One existing ground device consists of a braided strap which is ultrasonically welded at one end to an electrically conductive tube. The other end may be connected to a clip where the clip is constructed to be crimped onto one of the flaps of the shield.

There are a number of drawbacks to this device and the manner in which it is attached to the shield. First, the grounding device is relatively expensive since it is constructed of three different elements which must be connected together. Also, as mentioned, the manner of connection to the shield is less than ideal because there is a need to cut the shield thereby creating a location of high stress which will fail should a sufficient pulling force be applied to the shield. Another device is shown in U.S. Pat. No. 5,429,532. There, a device is disclosed which clamps to the cable shield. While the clamp lessens the stress on the cable shield when compared to a cut, the device is relatively expensive and relatively large. It is also cumbersome in use.

BRIEF SUMMARY OF THE INVENTION

The difficulties and disadvantages encountered by previous grounding devices and their method of attachment to a shielded cable have been overcome by the present invention. What is described here is an electrical conductor for connecting a shield of a shielded cable to a ground terminal comprising an elongated flexible strip of electrically conductive material having first and second end portions, a pair of oppositely disposed tabs integrally connected to the elongated flexible strip at the first end portion for connecting the first end portion to the strip at a region spaced from the first end portion, means integrally connected to the elongated flexible strip at the second end portion for connection to a ground terminal, and a region of projections located on the strip adjacent to the first end portion. The invention also includes a method for connecting an electrically conductive strip to a shield of a shielded cable for helping ground the shielded cable comprising the steps of providing a shielded cable, providing an elongated flexible strip of electrically conductive material having oppositely disposed tabs at a first end portion, means for connecting the strip to a ground terminal and projections in a region near the first end portion, exposing the shield of the shielded cable, wrapping the strip with the projections around the shield, and crimping the tabs to the strip wherein the projections engage the shield and make electrical contact.

An object of the present invention is to provide a simply constructed and inexpensive ground tie between a shield of a shielded cable and a ground terminal. Another aim of the present invention is to provide a ground tie which is easy to use and which does not need a predetermined orientation during connection of the ground tie and the shielded cable. A further aspect of the present invention is to provide a ground tie that makes a robust connection to the shield of the cable. Another object of the present invention is to provide a ground tie that allows connection to the shields of many different sized cables. Yet another advantage of the present invention is to provide a ground tie with an end to connect to a ground terminal that may be formed in any convenient shape.

A more complete understanding of the present invention and other objects, aspects, aims and advantages thereof will be gained from a consideration of the following description of the preferred embodiment read in conjunction with the accompanying drawings provided herein.

DETAILED DESCRIPTION OF THE INVENTION

Figure 1:
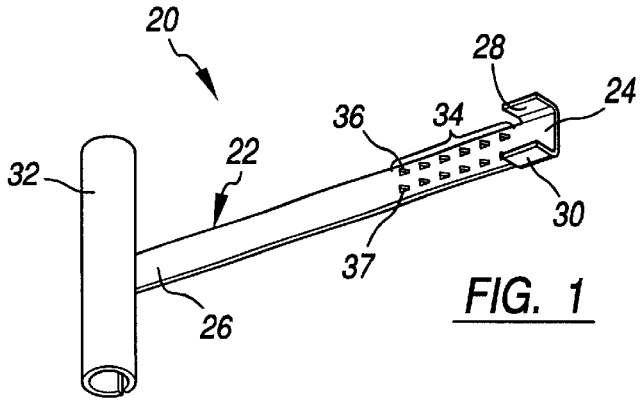
FIG. 1 is a top perspective view of the electrically conductive ground tie apparatus of the present invention.
Figure 2:
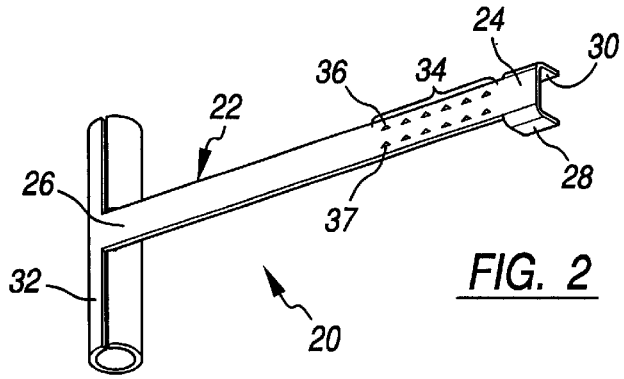
FIG. 2 is a bottom perspective view of the ground tie shown in FIG. 1.

While the present invention is open to various modifications and alternative constructions, the preferred embodiment shown in the drawings will be described herein in detail. It is understood, however, that there is no intention to limit the invention to the particular form disclosed. On the contrary, the intention is to cover all modifications, equivalent structures and methods and alternative constructions falling within the spirit and scope of the invention as expressed in the appended claims.

The ground tie apparatus of the present invention is inexpensive and simply constructed as can be seen in FIGS. 1–4. The ground tie apparatus makes a robust connection to a cable shield and is flexible both in design as well as material allowing it to attach to a wide range of cable sizes and even to multiple cables. Also the end of the ground tie that connects to a ground terminal may be fashioned into any one of many shapes such as the tubular sleeve which is shown or a planar ring or a pair of curved prongs which are not shown. These advantages may be appreciated by referring now to FIGS. 1–4. The ground tie apparatus 20 is an electrically conductive material formed as an integral item. The ground tie includes an elongated flexible strip 22 having a first end portion 24 and a second end portion 26. The ground tie also includes a pair of oppositely disposed tabs 28, 30 at the first end portion and means for connection to a ground terminal in the form of a rolled tubular sleeve 32. In a region 34 of the strip adjacent the first end portion 24 there are a series of projections such as the teeth 36, 37.

It is preferable that the ground tie be made of soft copper such as the material commonly referred to as copper alloy 110. In the preferred embodiment, the length of the elongated flexible strip is between 2.5 and 4 inches. The thickness of the ground tie is between 0.025 and 0.035 inches with a preference given to 0.032 inches. The sleeve 32 has an inner diameter of about 0.20 inches and an outer diameter of about 0.26 inches. The sleeve 32 is intended to be received by a cylindrical opening in a terminal block and is secured by a bolt. It is to be understood that other connection means may be formed at the second end portion such as a ring or a curved set of prongs depending upon the ground terminal to be engaged.

Figure 3:
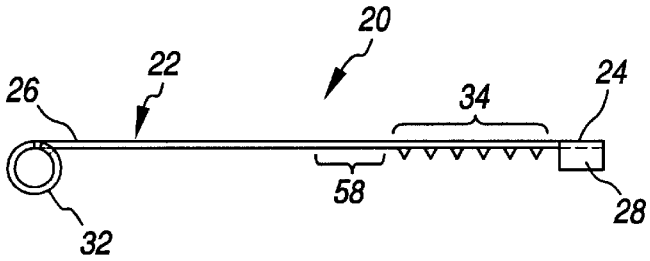
FIG. 3 is a side elevational view of the ground tie shown in FIGS. 1 and 2.
Figure 4:
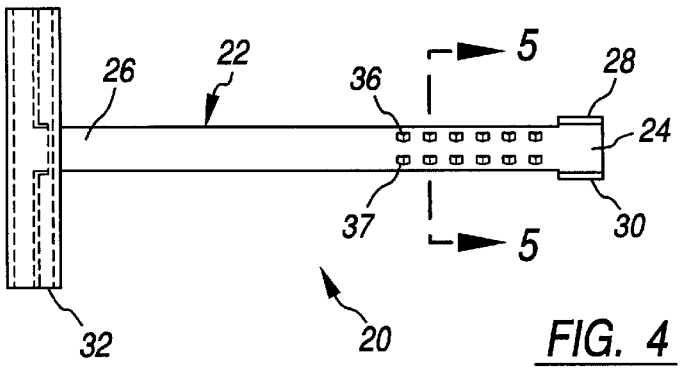
FIG. 4 is a top plan view of the ground tie shown in FIGS. 1–3.
Figure 5:
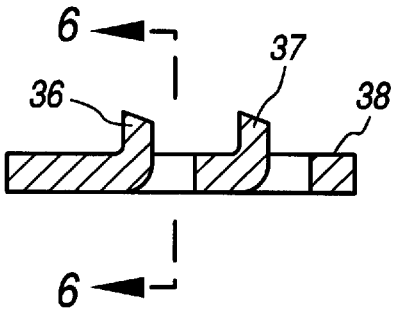
FIG. 5 is an enlarged sectional view taken along line 5—5 of FIG. 4.
Figure 6:
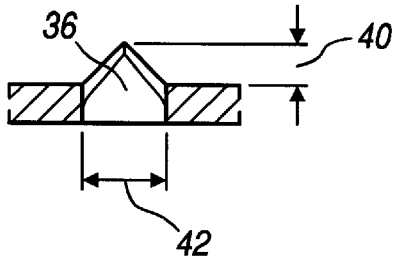
FIG. 6 is a sectional view taken along line 6—6 of FIG. 5.

Referring now to FIGS. 4, 5 and 6, the projections are illustrated in more detail. In keeping with the simple and inexpensive manufacture of the ground tie, the projections may be formed by punching sharp triangular teeth such as the two columns of seven teeth each shown in FIGS. 1–4. The length of the region 34 containing the projections is approximately 0.5 to 0.75 of an inch long. It is preferred that the height of the teeth above a top surface 38 of the strip is within the range of 0.020 to 0.030 inches with that dimension being represented by the double headed arrow designated 40. The width of the teeth at the base is about 0.050 inches which is represented by the double arrow designated 42.

Figure 7:
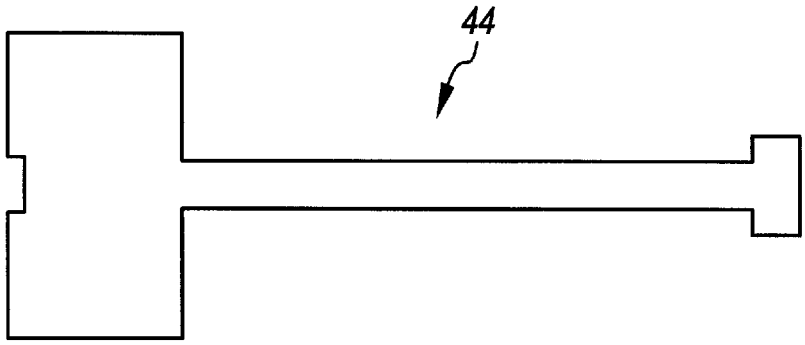
FIG. 7 is a top plan view of a flat blank of material from which the ground tie of FIGS. 1–4 is formed by stamping operations.

The simple and inexpensive construction of the ground tie apparatus can be seen by referring to FIG. 7. It can be appreciated that the ground tie is formed from a flat blank 44 after being cut from a longer strip of material. The blank may then be formed in a progressive die to the shape shown in FIGS. 1–4. Progressive dies and metal forming operations are well known to those skilled in the art thereof.

Figure 8:
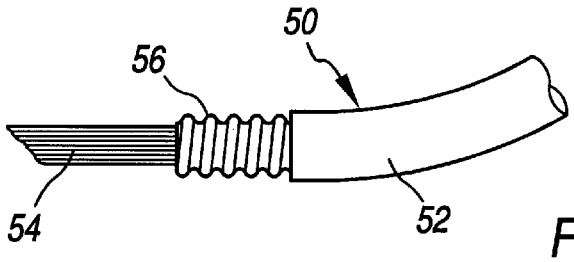
FIG. 8 is a front elevational view of a multi-pair cable showing an exposed shield.
Figure 9:
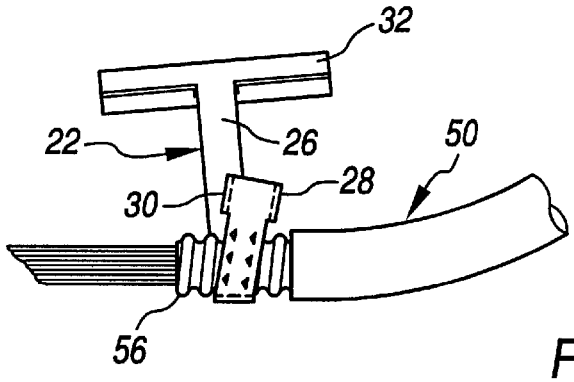
FIG. 9 is a front elevational view illustrating the wrapping of the ground tie shown in FIGS. 1–4 around the shield of the cable shown in FIG. 8.
Figure 10:
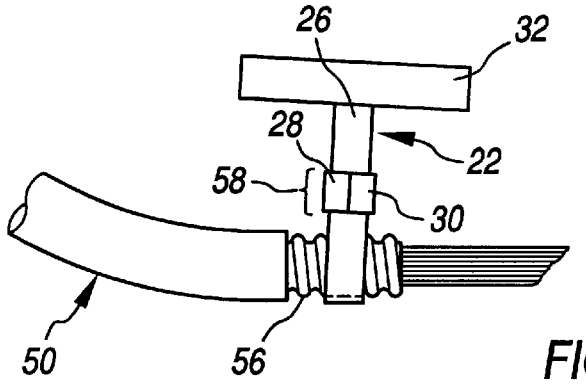
FIG. 10 is a back elevational view illustrating the crimping of the ground tie in a wrapped position around the circumference of the cable shield.

Referring now to FIG. 8, there is illustrated a shielded cable 50 such as those spliced into telephone trunk lines. This cable typically includes an outer insulative covering 52, a large number of paired electrical conductors 54 numbering usually between five and fifty pairs and a thin aluminum corrugated shield 56 surrounding the paired conductors. As mentioned above, current practice often involves cutting or slicing the shield and then slightly pulling it away from the paired conductors so that a grounding device can be crimped onto one of the two flaps created by the cut. Since the shield is thin and since the cut creates a location of high stress where the cut terminates, any kind of rough handling tends to tear off the flap, which has been connected to the ground device, from the rest of the shield. As shown in FIGS. 9 and 10, the ground tie 20 of the present invention does not require a slicing or cutting of the shield. Instead, the elongated flexible strip 22 of the ground tie is wrapped around the circumference of the shield rather tightly (FIG. 9) to allow the projecting teeth to "bite" into the thin shield and thereby make a good electrical and mechanical connection. Thereafter the tabs 28, 30 are bent from their position perpendicular to the plane of the strip 22 into positions where the tabs are generally parallel to the strip and crimped around the strip in a region 58 (FIG. 10) which is spaced from the first end portion 24 of the strip 22 and generally located between the region 34 containing the projecting teeth and the second end portion of the strip 26. This is best shown in FIG. 3.

Figure 11:
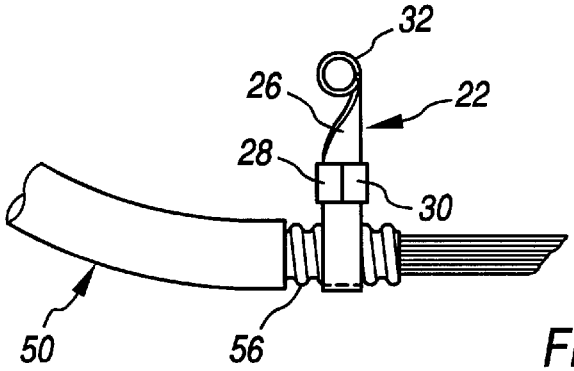
FIG. 11 is a back elevational view of the ground tie wrapped and crimped to the cable shield where the end of the ground tie has been reoriented by 90 degrees.

The grounding tie may be connected to a ground terminal such as that described where the sleeve 32 is inserted into a cylindrical opening in a terminal block (not shown). It does not matter what the orientation of the cable is in relation to the terminal block because the strip is flexible enough to be rotated or twisted 90 degrees if such is necessary to complete the connection of the sleeve. This is shown in FIG. 11. There, the sleeve 32 is 90 degrees removed from its position shown in FIG. 10. Hence, orienting the ground tie is quite simple and easily accomplished.

In use, the insulative outer layer 52 of the cable 50 is removed or pulled back to expose the shield 56. Once the shield is exposed, a ground tie may be wrapped around the shield circumference and the tabs crimped with the strip to provide a strong mechanical bond with good electrical integrity. Thereafter, the strip of the ground tie may be twisted to orient the sleeve into a desired direction. The projecting teeth strongly grip the shield so as to provide a tight non-slip wrap.

As can be appreciated, the method of attaching the ground tie to a cable is very easy and not at all labor intensive. The connection made between the ground tie and the cable shield is very robust and because of the nature of the connection, namely, wrapping and crimping, the ground tie can be used with a wide range of different sized cables. The ground tie itself is simply constructed and simply formed so that its cost may easily be one-tenth of the cost of the multi-element ground ties now in use and described above. Moreover, because the ground tie is one integral piece, a better electrical conductive path is formed when compared to an electrical path through a multiple element device.

The specification describes in detail an embodiment of the present invention. Other modifications and variations will, under the doctrine of equivalents, come within the scope of the appended claims. For example, changing the material of the ground tie or treating or plating the material would be considered an equivalent apparatus. Also altering the dimensions or the geometry somewhat would still be considered an equivalent structure. So will changing the shape of the teeth. Also, altering the shape of the connection means at the second end portion of the strip is also considered an equivalent structure. Still other alternatives will also be equivalent as will many new technologies. There is no desire or intention here to limit in any way the application of the doctrine of equivalents.

What is claimed is:

1. An electrical conductor for connecting a shield from a shielded cable to a ground terminal comprising:

an elongated flexible strip of electrically conductive material having first and second end portions;

a pair of oppositely disposed tabs integrally connected to said elongated flexible strip at said first end portion for connecting said first end portion to said strip at a region spaced from said first end portion;

means integrally connected to said elongated flexible strip at said second end portion for connection to a ground terminal;

a region of projections located on said elongated flexible strip adjacent to said first end portion; and a plurality of projections formed in said region of projections;

said elongated flexible strip is movable from a generally planar disposition to a curved or wrapped disposition about a cable shield wherein said projections engage said shield; and said tabs are movable from a position generally perpendicular to said strip to a crimped position generally parallel to said strip.

2. An apparatus as claimed in claim 1 wherein:

said projections are cut and bent pieces of said strip.

3. An apparatus as claimed in claim 1 wherein:

said region spaced from said first end portion is disposed between said region of projections and said second end portion of said strip.

4. An apparatus as claimed in claim 3 wherein:

said elongated flexible strip is soft copper; and said projections are cut and bent pieces of said strip.

5. An apparatus as claimed in claim 4 wherein:

said connection means is a tubular sleeve.

6. A method of connecting an electrically conductive strip to a shield of a shielded cable for helping ground said shield comprising the steps of:

providing a shielded cable;

providing an elongated flexible strip of electrically conductive material having oppositely disposed tabs at a first end portion, a connector for connecting said strip to a ground terminal at a second end portion, and projections in a region near said first end portion;

exposing the shield of said shielded cable;

wrapping said strip with said projections around said shield;

tightening the wrap around said shield; and bending said tabs over a portion of said strip between said region of projections and said second end portion.

7. A method as claimed in claim 6 including the step of:

twisting said second end portion for connecting said connector to a ground terminal.

8. An electrical conductor for connecting a shield from a shielded cable to a ground terminal comprising:

an elongated flexible strip of electrically conductive material having first and second longitudinally spaced end portions;

a pair of oppositely disposed foldable tabs integrally connected to said elongated flexible strip at said first end portion for connecting said first end portion to said strip after rotating said first end portion about an axis perpendicular to the longitudinal direction of said strip at a region longitudinally spaced from said first end portion;

a connector integrally connected to said elongated flexible strip at said second end portion for connection to a ground terminal;

a region of projections located on said elongated flexible strip adjacent to and spaced from said first end portion; and a plurality of projections formed in said region of projections;

wherein the region where said pair of oppositely disposed tabs connects said first end portion to said strip is spaced from said region of projections.

9. An apparatus as claimed in claim 8 wherein:

said region spaced from said first end portion is disposed between said region of projections and said second end portion of said strip.

10. An apparatus as claimed in claim 8 wherein:

said connection means is a tubular sleeve.

11. An apparatus as claimed in claim 8 wherein:

said elongated flexible strip is soft copper.

* * * * *